United States Patent [19]

Arduin

[11] Patent Number: 4,856,806

[45] Date of Patent: Aug. 15, 1989

[54] REVERSIBLE SKI BRAKE

[75] Inventor: Joel Arduin, Annecy-le-Vieux, France

[73] Assignee: Salomon S.A., Annecy-Cedex, France

[21] Appl. No.: 126,858

[22] Filed: Nov. 30, 1987

[30] Foreign Application Priority Data

Dec. 4, 1986 [FR] France ..... 86 16992

[51] Int. Cl.[4] ..... A63C 7/10

[52] U.S. Cl. ..... 280/605

[58] Field of Search ..... 280/605, 604, 611

[56] References Cited

U.S. PATENT DOCUMENTS

| | | | |
|---|---|---|---|
| 3,741,575 | 6/1973 | Bortoli | 280/605 |
| 4,014,563 | 3/1977 | Weigl et al. | 280/605 |
| 4,268,061 | 5/1981 | Unger | 280/605 |
| 4,294,458 | 10/1981 | Sedlmayr | 280/605 |
| 4,379,570 | 4/1983 | Sedlmair | 280/605 |
| 4,403,788 | 9/1983 | Bernard et al. | 280/605 |
| 4,453,731 | 6/1984 | Krob | 280/605 |

FOREIGN PATENT DOCUMENTS

| | | |
|---|---|---|
| 2833259 | 3/1979 | Fed. Rep. of Germany . |
| 2409061 | 6/1979 | France . |
| 2434634 | 3/1980 | France . |
| 591872 | 9/1977 | Switzerland . |

*Primary Examiner*—Charles A. Marmor
*Assistant Examiner*—Michael Mar
*Attorney, Agent, or Firm*—Sandler & Greenblum

[57] ABSTRACT

A ski brake including a spade having an arm pivotably mounted around a transverse pivot axis with an exterior end section equipped with an element adapted to engage snow and an opposite interior end section connected to a brake pedal; and an elastic device for biasing the spade in a manner so as to move the spade from an inactive position to an activated braking position wherein the element for engaging the snow is projected and maintained under the ski, wherein the elastic device for biasing functions as a device for absorbing shock when the spade is forced into a position beyond the activated braking position and as a device for returning the spade towards the activated braking position.

37 Claims, 5 Drawing Sheets

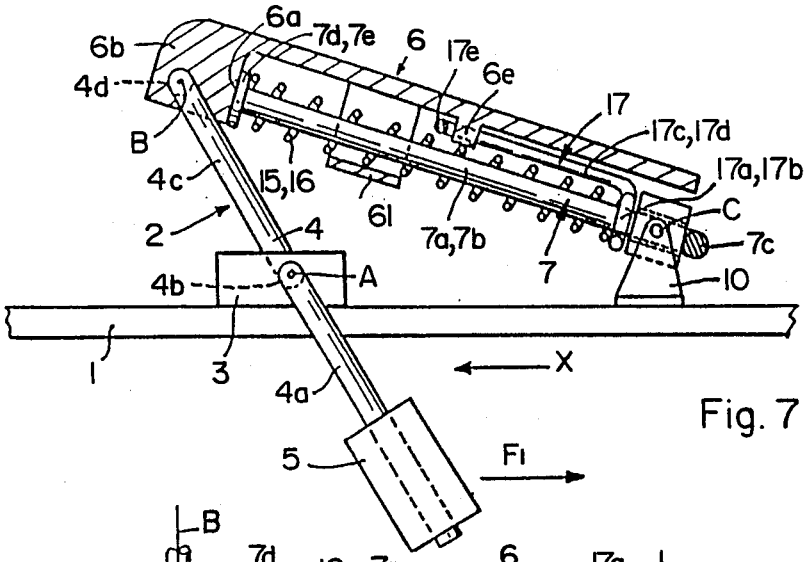
Fig. 7
Fig. 8
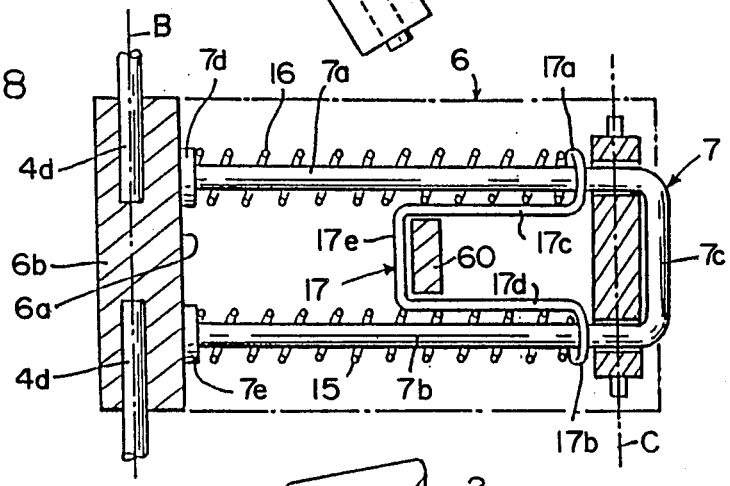
Fig. 9
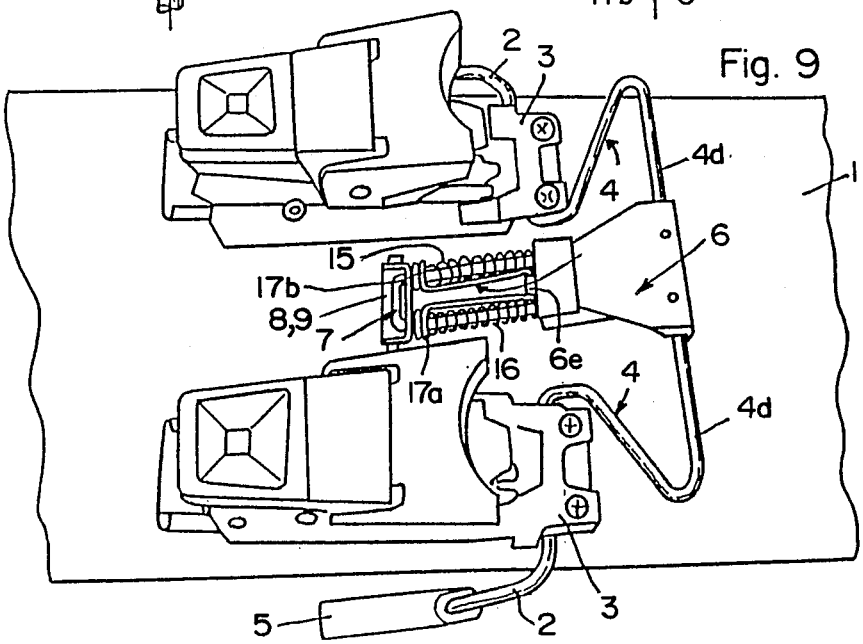

5
3
4d
15
17
6
1
8,9
7
16
4d
3
5
2

6a
6
7d
16
19a
7a
8
7
19c
7c
19b
18
6d
19
18b
18c
7c
9
7e
15
7b
18a
C 22b
6
22
16
7a
8
6
22a
6c
17c
17e
6d
17d
21b
17
21
15
17b
9
C 6
6a
7a
19b
19a
7
7d
19c
6c
18b
18
19
18c
6d
7e
7b
18a
C 6
6a
22
16
8
22b
22a
22b
9
21
15
21a
C

REVERSIBLE SKI BRAKE

BACKGROUND OF THE INVENTION

1. Field of the Invention

The present invention relates to a ski brake, i.e., an apparatus attached to a ski adapted to prevent the ski from sliding down a slope when, as a result of release of a safety binding during a fall, the ski is no longer associated with the skier.

2. Description of Background and Relevant Information

Conventional ski brakes, which are currently in use generally include a mechanism which is elastically biased and equipped with a pivotable spade located to the exterior on either side of the ski. The spade typically includes a brake plate, or shovel portion having a relatively large surface which is adapted to engage or dig into to anchor the ski in the snow when the ski brake is in the activated braking position. This plate is carried at an exterior end portion of arm pivotably mounted around a transverse axis of a base plate adapted to cooperate with the sole of a ski boot, such as one provided with an insertion designed to accommodate the base plate, affixed to the ski. The other end portion affixed to the pivotal arm, opposite to the exterior end portion forming the spade itself, is configured in a manner so as to be activated by a pedal on which the shoe or boot of the skier rests when the boot is inserted in the bindings on the ski. The arm carrying the brake plate in the snow is thus pivotably mounted in the boot insertion, around a transverse or substantially transverse axis, between an activated braking or working position, in which the plate extends beneath the ski in a position to dig into the snow, and an inactive or rest position, in which the plate is disengaged from the snow and positioned at the side of the ski above the snow.

In this manner, conventional ski brakes are adapted to prevent a ski, freed from the boot of a skier, from sliding down ski slopes particularly when the shovel or front end of the ski is directed downwardly. The spades of conventional ski brakes are normally inclined from top to bottom and from front to rear in the activated braking position, and these spades are maintained in the activated position by elastic return means which additionally function as shock absorbers. In this regard, if the spade contacts a rigid obstacle, such as a rock, the elastic return means permits the spade to be pushed back a bit by the obstacle in the direction of the inactive braking position so as to minimize damage to the spade.

Notwithstanding the fact that in many instances such a ski brake functions in a satisfactory manner, this is not always true, particularly if the ski hurtles or slides down a slope in the reverse position, i.e., with its rear or tail end directed down the ski slope. In this case, the spades can be subjected to shocks which tend to make the spades pass beyond the activated braking position and these shocks are then absorbed by the elasticity of the spades themselves. A permanent deformation of the spade can, therefore result, particularly if the shock is violent, thus putting the brake out of commission.

This problem is particularly critical in the case of a monoski which is heavier and which has a greater inertia than a normal ski and which, as a result, has a tendency to descend the slope backwards, i.e. with the tail end in front.

SUMMARY OF THE INVENTION

The present invention is directed to a ski brake composed of a spade including an arm pivotably mounted around a transverse pivot axis having an exterior end section equipped with an element adapted to engage snow and an opposite interior end section connected to a brake pedal; and an elastic means for biasing the spade in a manner so as to move the spade from an inactive position to an activated braking position wherein the element for engaging the snow is projected and maintained under the ski, wherein the elastic means functions as means for absorbing shock when the spade is forced into a position beyond the activated braking position and means for returning the spade towards the activated braking position, preferably wherein the spade inclines from top to bottom and front to rear in the activated braking position.

The pedal of the ski brake, described above, is preferably journalled at an anterior portion on an upper end portion of the arm and slidably mounted longitudinally on at least one shaft which is slidable longitudinally in a rear bearing pivotally mounted on the ski around a transverse axis so that a displacement of the spade beyond the activated braking position causes a rearward sliding movement of the pedal and elastic means for opposing the movement of the pedal beyond a position the pedal occupies when the ski brake is in the activated braking position.

Preferably, the ski brake, described above, includes two shafts having the same length and the pedal is slidably mounted on the two shafts by a linkage and return element including a generally U-shaped stirrup slidably mounted in rear bearings and connected by a transverse bar located at the rear of the bearings and constituting an edge limiting forward movement of the stirrup. In either case, each shaft has an enlarged head adapted press against springs surrounding the shaft and a support surface of the pedal during rearward movement of the pedal.

In one embodiment of the ski brake in accordance with the present invention, the pedal has a bottom surface provided with supports having openings, so that the shafts can pass through the openings. Preferably a pair of springs consisting of an anterior spring wound on a front section of each shaft between the head and the support and a posterior spring wound on a rear section of the shaft between the support and the rear bearing, are provided such that the posterior spring has a tension substantially equal to or less than the tension of the anterior spring.

In another embodiment, the pedal has a bottom surface provided with a protuberance in the form of an abutment, and the linkage and return element further includes a tie rod, preferably U-shaped having a transverse section adapted to contact the abutment formed by the protuberance and two longitudinal arms terminating in looped ends surrounding each of the arms of the stirrup, and a single spring wound around each of the longitudinal arms of the stirrup having an anterior end supported on a corresponding anterior head of the longitudinal arm and a posterior end supported against the looped end portion of the longitudinal arm of the stirrup, wherein the transverse section of the tie rod is situated in front of the protuberance which forms an abutment having an edge limiting the rearward sliding of the tie rod with respect to the pedal.

In yet another embodiment, the pedal is connected to the stirrup by means of a tie rod having at least two shafts including a longer shaft having a looped end portion around one arm of the stirrup and an elongate section which extends through one of the openings in the support affixed to the lower surface of the pedal and an enlarged head at an opposite end portion, and a shorter shaft having a looped end portion around another arm of the stirrup, an elongated section extending through another of the openings in the support, and an enlarged head at another end portion, and a spring wound on each of the arms of the stirrup between the looped end portion and on the head of the arm of the stirrup. Alternatively, the pedal may be connected to two longitudinal shafts of different lengths surrounded by springs wherein each of the shafts have an elongate section terminating in enlarged end portions and include a posterior enlarged portion positioned behind a pivoting bearing and an anterior enlarged portion adjacent a lower support surface of the pedal. In either case, in an activated braking position only the anterior enlarged portion of the longer shaft is in contact with the lower support surface of the pedal, the shorter shaft being situated at a distance from the lower support surface, and each of the springs being wound on a shaft and supported at an anterior end on the looped end portion with the transverse section being situated in front of the abutment of the pedal.

It is, therefore, an object of the present invention to provide a ski brake assembly including means for braking a ski adapted to be pivoted from a readiment position to an activated position for arresting a forward sliding ski and a rearward sliding ski; and means for activating the means for braking pivotably connected to the means for braking so as to permit the means for braking to be positioned in the activated position, wherein the means for braking includes a base adapted to be attached to a ski, and an exterior end portion journalled in the base and adapted to pivot downwardly through a plane perpendicular to a top surface of the ski, wherein the end portion has a free end and an elongate section inclining rearwardly and downwardly from the base towards the free end in an activated position for arresting a forwardly sliding ski and inclining forwardly and downwardly from the base towards the free end in an activated position for a rearwardly sliding ski.

Another object of the present invention is a ski brake assembly, as otherwise described above, wherein the means for braking includes an interior end portion journalled in the base adapted to pivot upwardly through a plane perpendicular to a top surface of the ski pivotally connected to the means for activating, and a transverse journal rotatably mounted in the base interconnecting the exterior end portion and the interior end portion of the means for braking; and the means for activating includes means for biasing the means for braking into the activated position adapted to be pivotally connected to the ski, and a pedal pivotally connected to the means for braking having means for contacting the means for biasing, in addition to a support adapted to be connected to the ski, and means for receiving the means for biasing pivotally mounted on the support.

Another further object of the present invention is to provide a ski brake, as described above, wherein the pedal is provided with means for supporting the means for biasing, and includes a foot plate having a bottom surface below which the means for supporting extends and the means for receiving includes an opening and the means for biasing includes at least one elongate element surrounded by at least one spring coil, the elongate element having one end portion slidably moveable through the opening and an opposite end portion adapted to contact the pedal. Preferably, the means for biasing includes at least one means for maintaining the spring coil on each elongate element, wherein the means for maintaining includes an enlarged portion attached to the opposite end portion of the elongate element, the enlarged portion having a dimension larger than the inner diameter of the spring coil, and a tie rod having an elongate section with one end portion adapted to contact the means for supporting.

Another still further object of the present invention is to provide a ski brake, as described above, wherein the means for biasing includes a tie rod having an opposite end portion provided with an annular section looped around the elongate element contacting an end of the spring coil, wherein the means for supporting has an orifice and the elongate element passes through the orifice, preferably wherein the elongate element has a free end provided with a cap having a dimension larger than any dimension of the orifice. The means for biasing preferably includes two spring coils surrounding the elongate element, wherein the means for supporting is positioned between the two spring coils and the elongate element passes through the orifice, preferably wherein each of the spring coils have substantially the same tension, although the forward spring coil may have a tension different from a rear spring coil, i.e., the tension of the forward spring coil may be greater than the tension of the rear spring coil.

Another object of the present invention is to provide a ski brake, as otherwise described herein, wherein the means for biasing include two elongate elements, and each of the two elongate elements includes an end provided with the enlarged portion, and are interconnected by a transverse section between opposite ends, which is positioned rearwardly of the means for receiving, preferably wherein one the two elongate members is longer than another of the two elongate members, or wherein the means for biasing includes a tie rod having an elongate section associated with each of two elongate members of equal length, wherein the elongate section of one of the tie rods is longer than the elongate section of another of the tie rods.

BRIEF DESCRIPTION OF THE DRAWINGS

The invention will now be described with reference to non-limiting examples of several embodiments of the present invention, with reference to the annexed drawings in which:

FIG. 7 is a schematic side elevational view of another ski brake according to the invention, the spade of the ski brake being shown in the activated braking position;

FIG. 8 is a partial planar schematic view of the ski brake of FIG. 7;

FIG. 9 is a perspective view of a monoski equipped with a ski brake, such as shown in FIGS. 7 and 8, in the activated braking position;

DESCRIPTION OF PREFERRED EMBODIMENTS

Figure 1:
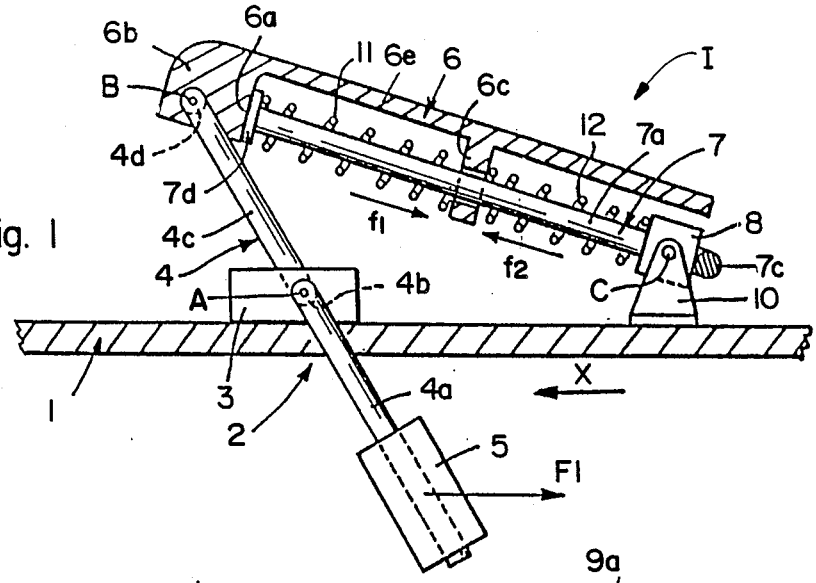
FIG. 1 is a schematic side elevational view of a ski brake according to the invention, the spade of the ski brake being shown in the activated braking position.

The present invention relates to improvements in ski brakes of the type described above for purposes of increasing their effectiveness regardless of which end of a ski, i.e., the shovel or the tail end, points forwardly as the ski slides down a slope.

In general, the ski brake assembly in accordance with the present invention includes a spade composed of an arm activated by a brake pedal movably mounted around a transverse pivot axis and whose end portions, situated at the exterior of the ski, include an anchorage element or shovel for engaging the snow, and an elastic return means normally biasing the spade in a manner so as to force it from its inactive position to its activated braking position in which the exterior end portion or anchorage element projects under the ski, and to maintain the spade in that position. The ski brake assembly is equipped with an elastic means for absorbing shock, i.e. a shock absorber, which comes into play if the spade is displaced beyond its activated braking position which urges the return of the spade towards its activated braking position.

The ski brake assembly in accordance with the present invention, which is generally designated I in FIGS. 1–6, is shown to be mounted on a ski 1. This brake includes, in a conventional manner, a spade 2 which is pivotably mounted around a transverse axis A in a base 3 affixed to the ski. The spade 2 is constituted by an arm 4 and by an anchorage plate for shovel 5 for anchoring or digging into the snow. The arm 4 is preferably composed of a shaft which is bent or composed of sections pieced together successively from the exterior to the interior of the ski. The spade 2 includes an extreme posterior end exterior section 4*a* extending longitudinally towards the rear or tail end of the ski in the inactive position and on which is affixed the shovel 5; an intermediate transverse section 4*b*, extending through a transverse bore in base 3 thereby forming the transverse pivot axis A of spade 2; an internal section 4*c* extending longitudinally away from base 3 towards the front or tip end of the ski in the inactive position; and an anterior end transverse section 4*d* extending from the preceding section towards the interior of pedal 6 described in more detail hereinbelow. The anterior end transverse section 4*d* constitutes the section of spade 2 on which the force of the ski boot is exerted by means of a pedal 6 to retract the ski brake to the inactive position in which spade 2 extends substantially horizontally slightly above the top surface of ski 1. The anterior end transverse section 4*d* thus forms a journal axis B of spade 2 transversely through pedal 6, which is situated in front of the pivot axis A of the spades when the brake is in the inactive position.

In the embodiment illustrated in FIGS. 1–6, the pedal 6, composed of a transverse front or nose portion 6*b*, is slidably mounted on a linkage and return element 7 in the form of a generally U-shaped stirrup which is opened towards the front or tip end of the ski. Stirrup 7 includes two longitudinal arms 7*a* and 7*b*, preferably of substantially the same length, connected to one another at their posterior end portions by a transverse section or bar 7*c*. The longitudinal arms 7*a* and 7*b* are themselves slidably mounted, in their posterior portions, in bearings 8 and 9, or a common transverse bearing bar 89, which are pivotably mounted on one or more supports 10 affixed to the ski, around a single horizontal and transverse axis C situated to the rear with respect to the two transverse previously described axes A and B. The transverse bar or section 7*c* of stirrup 7 is situated to the rear of the two bearings 8 and 9 and bearing bar 89 so that section 7*c* thus constitutes an edge limiting the frontward sliding of arms 7*a* and 7*b* of stirrup 7 which extends in a forward direction.

The front ends of longitudinal arms 7*a* and 7*b* of stirrup 7 contact an interior transverse surface 6*a* of nose portion 6*b* of pedal 6, in which the anterior end transverse sections 4*d* of arms 4 are engaged and maintained. Pedal 6 also includes pedal plate 6*e* which carries, on its lower surface, two supports or hangers having orifices or eyelets 6*c* and 6*d*, which project downwardly and are situated in a single transverse plane through which arms 7*a* and 7*b* of stirrup 7, respectively, pass. Compression springs 11, 12, 13, and 14 are engaged on the two longitudinal arms 7*a* and 7*b* of stirrup 7. The anterior compression springs 11 and 13 are positioned on arms 7*a* and 7*b*, respectively, between enlarged heads 7*d* and 7*e* provided at the two anterior ends of the respective arms 7*a* and 7*b* and supports 6*c* and 6*d* positioned rearwardly towards the middle of the pedal. These heads 7*d* and 7*e* contact the interior contact surface 6*a* of nose portion 6*b* of pedal 6. The two other posterior compression springs 12 and 14 surround the portions of arms 7*a* and 7*b* which extend between supports or hangers 6*c* and 6*d* and bearings 8 and 9, respectively.

Figure 2:
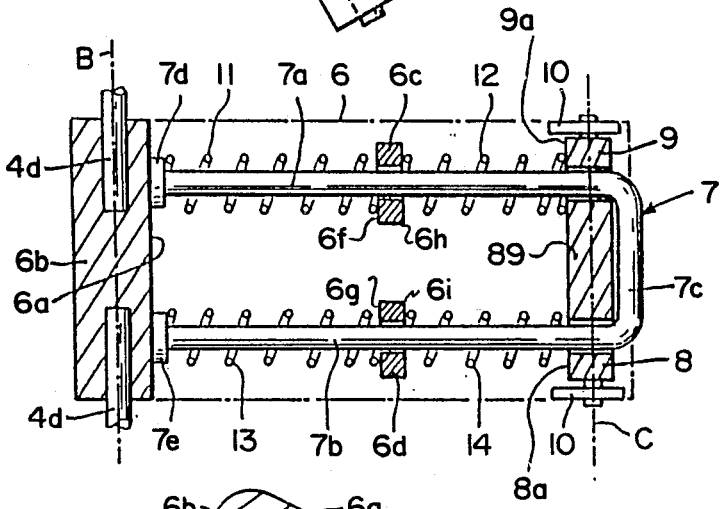
FIG. 2 is a partial top planar schematic view of the ski brake of FIG. 1.

In the activated braking position, which is shown in FIGS. 1 and 2, the pedal 6 and each arm 4 are maintained in positions which are inclined with respect to the longitudinal plane of the ski from top to bottom and front to rear, the inclination of arms 4 being greater than the inclination of pedal 6. In this equilibrium position, the three transverse axes B, A, C, from left to right as one views the drawings, form a "broken" toggle, the anterior axis B being lifted with respect to the upper or top surface of ski 1. This equilibrium position is caused by springs 11, 12, 13 and 14 which are either totally decompressed or slightly prestressed in compression. Stated another way, axes A, B, C form a "movable triangle" in which the "side" between axes B and C has a variable length.

In the first case, the longitudinal position of supports 6c and 6d under pedal 6 is selected such that the distance between the front surfaces 6f and 6g of these supports 6c and 6d and the interior support surface 6a of nose portion 6b is substantially equal to the length of anterior springs 11 and 13 in a totally decompressed state. Similarly, the distance between the posterior surfaces 6h and 6i of support 6c and 6d and the anterior support surfaces 8a and 9a of bearings 8 and 9 is substantially equal to the length of the posterior springs 12 and 14 when they are in a totally decompressed state.

In the second case, the springs 11, 12, 13, and 14, which are slightly prestressed in compression, exert antagonistic or opposing forces f1 and f2 on supports 6c and 6d of pedal 6. In this regard, it should be pointed out that forces fl exerted towards the rear by anterior springs 11 and 13 are greater than the forces f2 exerted towards the front by the posterior springs 12 and 14 so that the resulting overriding force is directed towards the rear and pedal 6 tends to be pressed by means of its interior contact surface 6a, against heads 7d and 7e of arms 7a and 7b. As a result, stirrup 7 is pulled frontwardly so that its transverse section or bar 7c comes to rest against or contacts the back of bearings 8 and 9 and bearing bar 89. The anterior transverse end sections 4d of arms 4 are subjected to a resulting force exerted in the direction of pivot axis C of bearings 8 and 9, which serves to maintain these anterior transverse end sections 4d in a lifted or raised position with respect to ski 1, so that the shovel plates of spades 5 are positioned beneath ski 1, so as to dig into the snow.

If the ski brake assembly is in the activated braking position, as the ski slides on a slope with its shovel directed downwardly, i.e., from right to left in the direction of arrow X in FIG. 1, spades 5 are subjected to a force Fl directed towards the rear, which tends to pivot each arm 4 in the counterclockwise direction around axis A. This pivoting movement is transmitted by end sections 4d to pedal 6 which thus tends to slide on arms 7a and 7b of stirrup 7 in the direction of the heads 7d and 7e. This translates into a compression of the anterior springs 11 and 13 which thus serve as elastic shock absorber for the forces Fl or shocks being exerted from the front towards the rear of the ski, along arrow Fl, on spades 5. Consequently, the ski brake operates in a normal manner.

Figure 3:
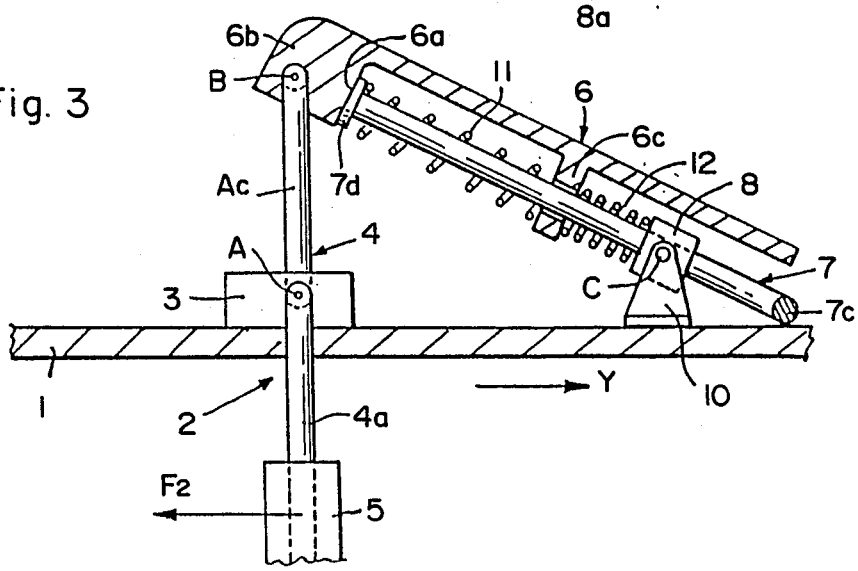
FIG. 3 is a schematic side elevational view of the ski brake of FIG. 1 whose spade is subjected to a force tending to make it pass beyond the active braking position.
Figure 4:
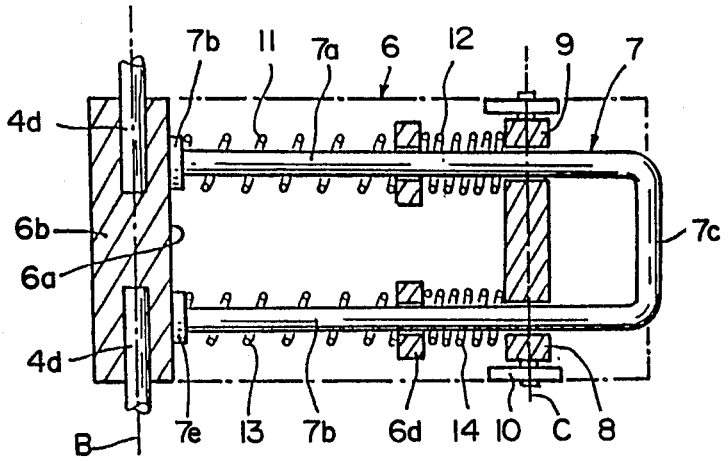
FIG. 4 is a top planar schematic partial view of the ski brake of FIG. 3.

If a ski 1, detached from the foot of the skier, slides in the opposite direction down a slope, i.e., with its rear or tail end directed downwardly, i.e., from left to right along arrow Y in FIG. 3, however, the ski brake assembly operates in a manner illustrated in FIGS. 3 and 4. In this case, the spades 5 are subjected to a force F2 which is directed towards the front of the ski and which translates into a pivoting of arms 4 in the clockwise direction around axis A. This pivoting movement, which is transmitted by the anterior transverse end sections 4d to pedal 6, causes a displacement of pedal 6 towards the rear of the ski. Inasmuch as pedal 6 is in contact, through its interior support surface 6a, with heads 7d and 7e, pedal 6 in its entirety causes the displacement of stirrup 7 in its entirety towards the rear of the ski so that transverse section or bar 7c of stirrup 7 moves rearwardly away from bearings 8 and 9 and bearing bar 89. As a result of this displacement, the anterior springs 11 and 13 relax, if they were prestressed in the activated braking position, or they remain non-compressed, while the posterior springs 12 and 14 are themselves compressed between the supports 6c and 6d and the bearings 8 and 9. The posterior springs 12 and 14 thus function as elastic shock absorbers when the ski slides down a slope leading with its rear or tail end directed downwardly.

Figure 5:
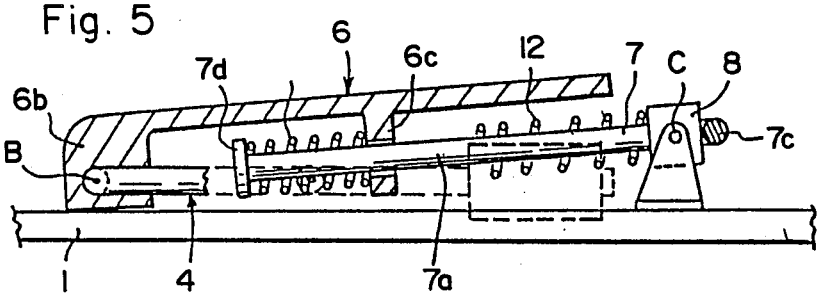
FIG. 5 is a schematic side elevational view of the ski brake according to the invention, the spade being shown in the inactive position, as would be the case when retracted flat on the ski.
Figure 6:
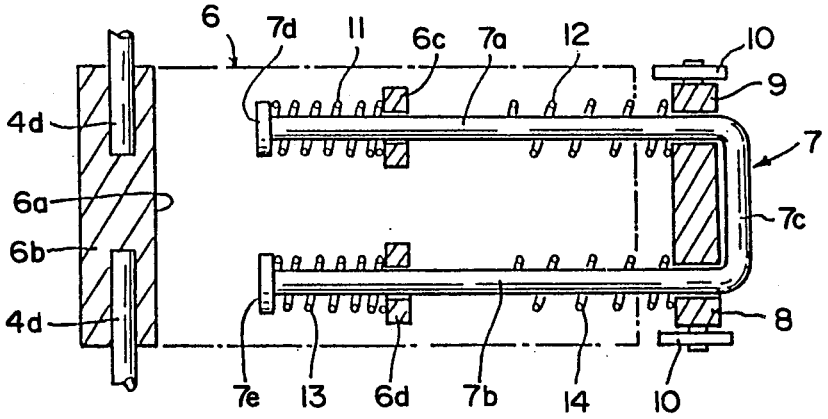
FIG. 6 is a partial schematic top planar view of the ski brake of FIG. 5.

FIGS. 5 and 6 illustrate the position of the ski brake assembly in the inactive position, i.e., during skiing, when the boot (not shown) rests on pedal 6. In this case, arms 4 are pivoted in the substantially horizontal position, which translates into a relative displacement of their end sections 4d towards the front of the ski. This displacement causes a concomitant displacement of pedal 6 by sliding in a forward direction with respect to stirrup 7, i.e. toward the shovel or tip end of the ski. The supports 6c and 6d are likewise displaced in a forward direction on arms 7a and 7b of stirrup 7, thereby compressing the anterior springs 11 and 13, respectively, between supports 6c and 6d and heads 7d and 7e. In contrast, the posterior springs 12 and 14 remain distended. The toggle composed of the three axes B, A and C thus forms an obtuse angle of approximately 180°, which is opened slightly upwardly. Thus, when the ski is detached, i.e., when the boot is no longer resting on pedal 6, the anterior springs 11 and 13 relax by pushing towards the rear against supports 6c and 6d which serves to break the toggle B, A and C, and to make axis B pivot upwardly around axis A. This assures the automatic return of the ski brake to the activated braking position shown in FIGS. 1 and 2.

From the preceding description of the operation of the ski brake assembly shown in FIGS. 1–6, it should be clear that anterior springs 11 and 13 function as elastic return elements which cause the ski brake to automatically pass from its inactive position to its activated braking position while posterior springs 12 and 14 act as elastic shock absorbers in the case where the spades 2 are moved beyond their normal activated braking position. Related to this, the anterior springs 11 and 13 can have the same tension as the posterior springs 12 and 14 or a different tension. In the latter case, the anterior springs 11 and 13, which operate during the movement between the activated braking position and the inactive position and vice versa, have a tension greater than the tension of the posterior springs 12 and 14 which function only as shock absorbers when spades 2 are moved beyond their activated braking position.

According to an alternative embodiment of the invention, stirrup 7, previously described as having two arms, can be replaced by a single longitudinal shaft, or a plurality of shafts, e.g. more than two shafts, otherwise attached to pedal 6 in a manner similar to stirrup 7, i.e., each shaft is provided at one end with an enlarged head portion equivalent to heads 7d and 7e and the elongated portion passes through a pedal support or hanger, equivalent to supports 6c and 6d, and bearing bar 89. In the case where the stirrup 7 is replaced by a single bar, the rear end of the shaft would also be provided with an enlarged portion or equivalent means for maintaining the shaft in position with respect to pedal 6 and bearing bar 89. If more than two shafts are used for this purpose, each shaft may be provided with such an enlarged rear end portion, or the rear ends of the shafts may be interconnected by a transverse bar analogous to transverse bar 7c. The pedal 6 would also be designed to have an appropriate number of supports or hangers equivalent to previously described supports 6c and 6d, through which the shafts would pass, and each shift would be provided with an anterior compression spring and a posterior compression spring equivalent to anterior compression springs 11 and 13 and posterior compression springs 12 and 14.

In the embodiment of the invention illustrated in FIGS. 7–14, the elastic return mechanism and shock absorber include only one compression spring wound around each shaft, e.g., corresponding to longitudinal arms 7*a* and 7*b* of stirrup 7, i.e. two compression springs 15 and 16, instead of four springs 11, 12, 13, and 14 as in the previously described embodiment. In this case springs 15 and 16 are wound over substantially the entire length of the respective longitudinal arms 7*a* and 7*b* of stirrup 7. Similarly each of the springs 15 and 16 are supported, at their anterior ends, respectively, on enlarged portions or heads 7*d* and 7*e* of the shafts 7*a* and 7*b* of stirrup 7 and, at their posterior ends, on end portions 17*a* and 17*b* of tie rod 17. As shown, tie rod 17 has the general shape of a U which opens in a direction opposite from the U-shaped stirrup 7 towards the rear. This tie rod 17 is preferably composed of a bent shaft whose free end sections 17*a* and 17*b* are curved or looped in a manner so as to constitute rings which can slide on arms 7*d* and 7*e*. The tie rod 17 also includes two longitudinal sections or arms 17*c* and 17*d* which begin at looped or ringed end portions 17*a* and 17*b* and which are connected to one another, at their anterior ends, by a transverse section or bar 17*e*. This transverse section 17*e* extends in front of a central abutment 60 provided under the lower surface of pedal 6 for limiting the sliding of tie rod 17 towards the rear. If desired, a supplementary support element or guide 61 in the form of a U, is affixed to the underside of the pedal which is traversed by compression springs 16 and 15 wound around arms 7*a* and 7*b* of stirrup 7 to assist maintaining the springs 16 and 15 and longitudinal arms 7*a* and 7*b* in position 80 heads 7*d* and 7*e* will be properly aligned to contact transverse interior surface 6*a* of nose 6*b* of pedal 6.

In the activated braking position, which is shown in FIGS. 7–9, springs 15 and 16 can either be totally distended or slightly prestressed. As illustrated, the abutment 60 of pedal 6 is positioned just to the rear of transverse section 17*e* of tie rod 17, so that the pedal 6 rests, via its transverse interior surface 6*a*, against heads 7*d* and 7*e* of arms 7*a* and 7*b* of stirrup 7, and the looped end sections 17*a* and 17*b* of tie rod 17 are applied against the transverse bar 89 or bearings 8 and 9 pivotably mounted around transverse axis C. Consequently, springs 15 and 16, which are preferably slightly compressed in the activated braking position, push the looped end sections 17*a* and 17*b* of tie rod 17 into contact with bearings 8 and 9 and bearing bar 89, and transverse section 17*e* against the abutment 60, so as to maintain the pedal 6 offset toward the rear in a manner such that the transverse interior surface 6*a* presses against heads 7*d* and 7*e*. To this end, it is necessary that the length of longitudinal sections or arms 17*c* and 17*d* of tie rod 17 corresponds substantially to the distance between abutment 60 and the anterior surfaces of the pivoting bearings 8 and 9 or bearing bar 89.

In operation, when the ski brake assembly of the present invention is mounted on a ski, if a ski 1 becomes detached from a skier or otherwise slides unattended down a slope with its front end or shovel directed downwardly, i.e., from right to left in the direction of arrow X in FIG. 7, the forces or shocks Fl exerted on plates 5 are absorbed by the elastic mechanism composed of the two springs 15 and 16. Otherwise stated a shock along arrow Fl tends to pivot arms 4 in the counterclockwise direction around axis A, which causes a pivoting of pedal 6 and of stirrup 7 around axis C in the same direction. Because the pivot axis A of arms 4 is situated in front with respect to the pivot axis C of stirrup 7, pedal 6 is pushed in a forward direction by means of anterior end sections 4*d* of arms 4 and the pedal 6 slides forwardly on longitudinal arms 7*a* and 7*b* of stirrup 7. This forward motion of the pedal 6 is permitted because pedal 6 is coupled to stirrup 7 by tie rod 17 which freely slides on arms 7*a* and 7*b* via curved annular or looped ends 17*a* and 17*b*. As pedal 6 slides forwardly it contacts between abutment 60 and transverse section 17*e* and, consequently, causes a forward displacement of the tie rod 17, so that the looped ends 17*a* and 17*b* of the tie rod 17 cause the compression of springs 15 and 16 against heads 7*d* and 7*e* in a manner such that the springs 15 and 16 act as elastic return means for returning the brake to the activated braking position.

Figure 10:
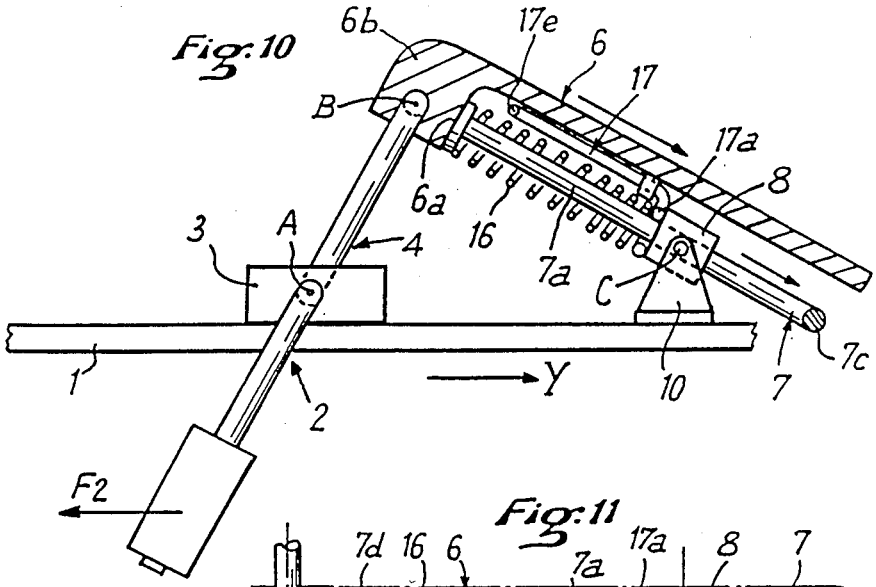
FIG. 10 is a schematic side elevational view of the ski brake of FIG. 7 whose spade is subjected to a force tending to make it pass beyond the active braking position.
Figure 11:
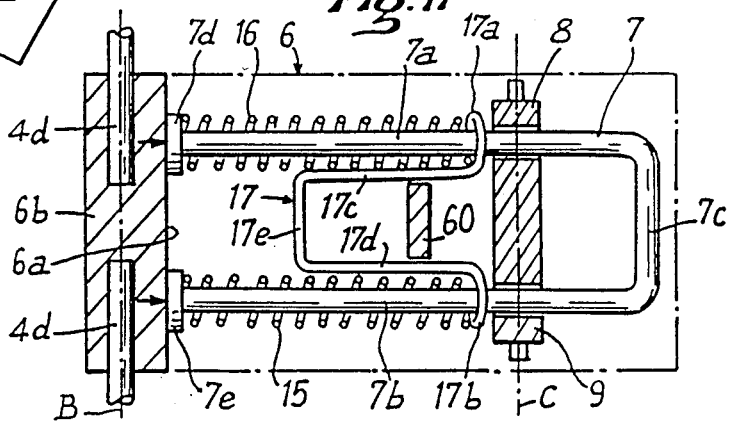
FIG. 11 is a partial schematic top planar view of the ski brake of FIG. 10.

On the other hand, if the ski slides down a slope with its rear or tail end directed downwardly, i.e., in a direction from left to right as shown, along arrow Y in FIGS. 10 and 11, the arms 4 of the ski brake are subjected to forces F2 opposite to previously discussed forces Fl. As is shown in FIG. 10, this causes a pivoting of arms 4 in the clockwise direction around axis A. This pivoting movement is transmitted to the axis B situated at the anterior and upper end of pedal 6, i.e. pedal support 6*b*, which is thus pushed downwardly and towards the rear, as is shown in FIGS. 10 and 11. The pedal 6 by means of its transverse interior surface 6*a*, in turn pushes stirrup 7 towards the rear and downwardly, thereby causing stirrup 7 to slide in the pivotably bearings 8 and 9. Inasmuch as enlarged heads 7*d* and 7*e* of arm 7*a* and 7*b* of stirrup 7 are pushed towards bearings 8 and 9, springs 15 and 16, which rest on these bearings 8 and 9 are thus compressed. Pedal 6 is capable of sliding towards the rear because the tie rod 17 is freely mounted with respect to pedal 6 except for restraint in a rearward direction once transverse section 17*e* engages central pedal abutment 60. Consequently, as shown in FIGS. 7–14, the ski brake according to the present invention also provides elastic shock absorption even in the case where the ski slides down a slope with its rear or tail end directed downwardly.

Figure 12:
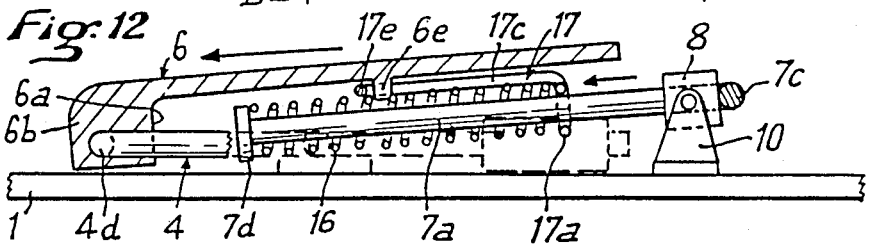
FIG. 12 is a schematic side elevational view of the ski brake of FIG. 7, the ski brake spade being shown in the inactive position.
Figure 13:
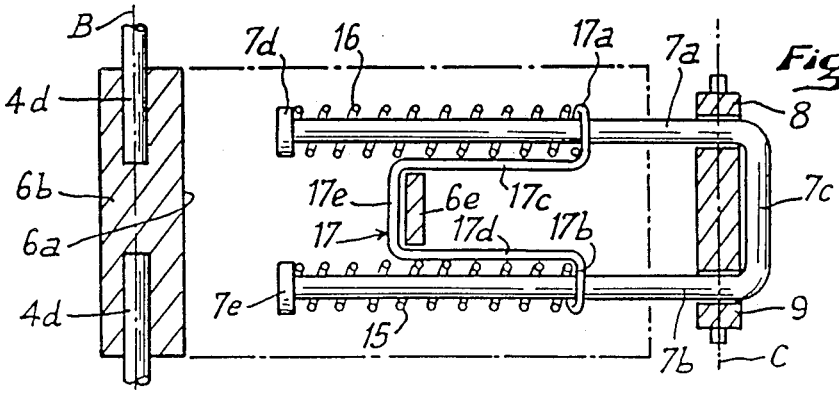
FIG. 13 is a partial schematic top planar view of the ski brake of FIG. 12.
Figure 14:
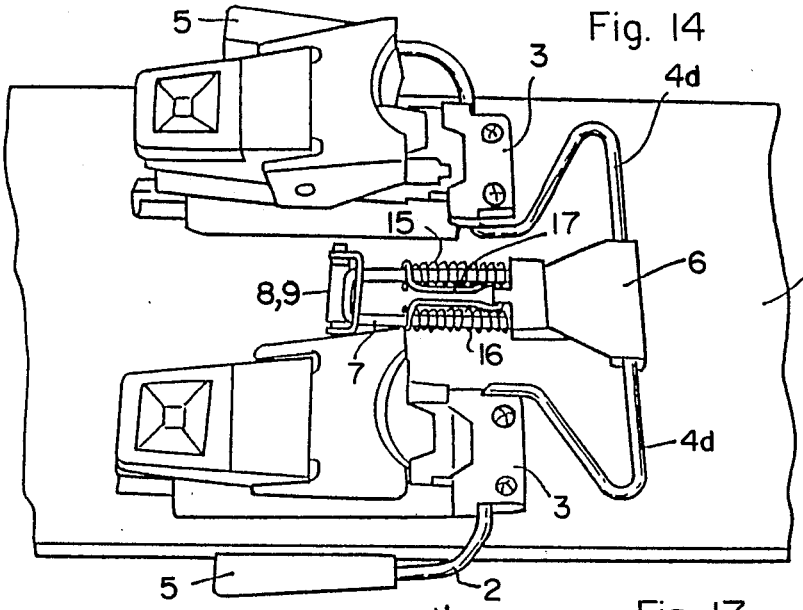
FIG. 14 is a perspective top view of the ski brake of FIG. 7 in the inactive position.

FIGS. 12–14 illustrate the ski brake previously discussed with respect to FIGS. 7, 8, 10 and 11, in the inactive position, i.e. substantially flat on the ski. In this position, pedal 6, which is substantially horizontal, is offset frontwardly with respect to stirrup 7. Tie rod 17, however, is offset rearwardly on stirrup 7 such that transverse section 17*e* of tie rod 17 contacts abutment 6*e* of pedal 6 which causes a compression of springs 15 and 16 between the rear looped end sections, 17*a* and 17*b* of tie rod 17 and the front heads 7*d* and 7*e* of stirrup 7. Here again, the three pivot axes A, B and C form an obtuse angle of approximately 180° which is upwardly open. Consequently, as soon as pressure against pedal 6 is released, springs 15 and 16 decompress thereby causing the elastic return of arms 4 and of pedal 6 to the active braking position as is shown in FIGS. 7 and 8.

It is thus seen from the preceding description that in the embodiment of the ski brake shown in FIGS. 7, 8 and 10–14, each of springs 15 and 16 functions, on the one hand, as an elastic means for returning the ski brake automatically from an inactive position to an activated braking position and, on the other hand, as an elastic means for absorbing shock if spades 2 tend to be moved beyond their activated braking position.

In a manner similar to the previously discussed embodiments, the ski brake can include, instead of stirrup 7 having two arms, a single longitudinal shaft slidably engaged longitudinally in a pivotable bearing bar 89, or bearings 8 and 9, and provided with an enlarged head at its front end, and a single spring, analogous to springs 15 and 16. In this case, the pedal would have a single hanger or support, similar to pedal supports or hangers 6*c* and 6*d* of the previously discussed embodiment provided with an eyelet or opening through which the single arm of the tie rod would slide. The tie rod would thus be provided at its front end with an enlarged head portion or other means for preventing passage of the arm through the opening in the pedal hanger and a loop at its rear end similar in structure and function to looped end sections 17*a* and 17*b*.

Figure 15:
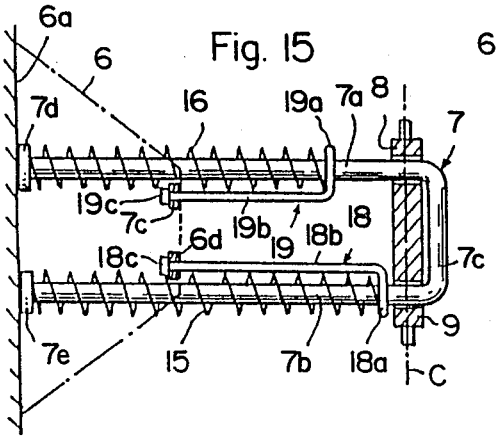
FIGS. 15, 16, 17 and 18 are partial schematic planar view of alternative embodiments of the ski brake in accordance with the present invention.
Figure 16:
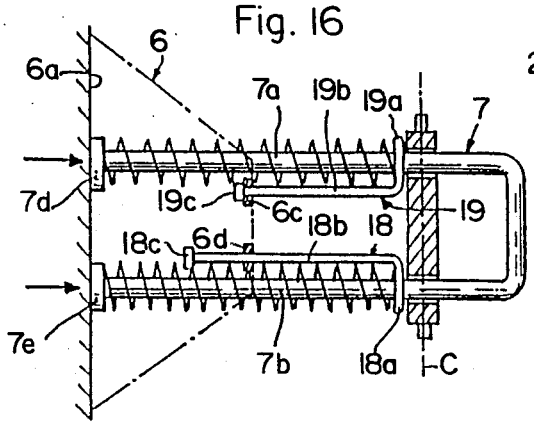

In the embodiment of the invention shown in FIGS. 15 and 16, pedal 6 is connected to stirrup 7 by means of two independent tie rods 18 and 19 of different lengths. The tie rod 18, which is the longer of the two tie rods, is curved at it posterior end portion 18*a* into a ring or loop around arm 7*b* of stirrup 7, and it includes a longitudinal arm or section 18*b* which extends through an opening or eyelet in a hanger 6*d* affixed to the lower or bottom surface of pedal 6. The anterior end portion of a tie rod 18 is provided with an enlarged head 18*c*. The other shorter tie rod 19 includes substantially the same elements, namely an end portion 19*a* curved into a ring or loop around arms 7*a* of stirrup 7, and a longitudinal section arm 19*b* which extends through an eyelet of hanger 6*c* of pedal 6 and terminates at its anterior end portion in an enlarged head 19*c*. Spring 15 wound around longitudinal arm 7*b* of stirrup 7 is supported, on the one hand, on the end portion curved into a ring or looped end portion 18*a* of the longer tie rod 18 and, on the other hand, on an enlarged head 7*e* of longitudinal arm 7*b* of stirrup 7. The other spring 16, wound around longitudinal arm 7*a* of stirrup 7 is supported, on the one hand, on the posterior looped end portion curved into a ring 19*a* of tie rod 19 and, on the other hand, on an enlarged head 7*d* of the other arm 7*a* of stirrup 7.

In FIG. 15, pedal 6 and stirrup 7 of the ski brake are shown in the activated braking position. When the ski brake of this embodiment is brought into the inactive position, by flattening pedal 6 on the ski, the two tie rods 18 and 19 are simultaneously displaced forwardly on the longitudinal corresponding arms 7*b* and 7*a* of stirrup 7, because the pedal supports or hangers 6*c* and 6*d*, affixed to pedal 6, move forwardly with pedal 6 and the heads 19*c* and 18*c* of tie rods 19 and 18 prevent passage of the tie rods through the openings in supports 6*c* and 6*d*. This causes a simultaneous compression of the two springs 15 and 16 which thus cooperate during this movement between the two positions, namely the activated braking position and the inactive position and vice versa. On the other hand, when the ski brake is moved under the effect of force F2 beyond the activated braking position, as is shown in FIG. 10, stirrup 7 is pushed towards the rear, as shown in FIG. 16, by sliding in the pivoting bearings 8 and 9, in which case only spring 15 is initially compressed due to the fact that the longer tie rod 18 rests, through its looped end portion 18*a* against the pivot bearings 8 and 9. The second spring 16 does not come into play until the shorter tie rod 19 comes into contact through its looped end section 19*a* against the pivot bearings 8 and 9 as is shown in FIG. 16.

Figure 17:
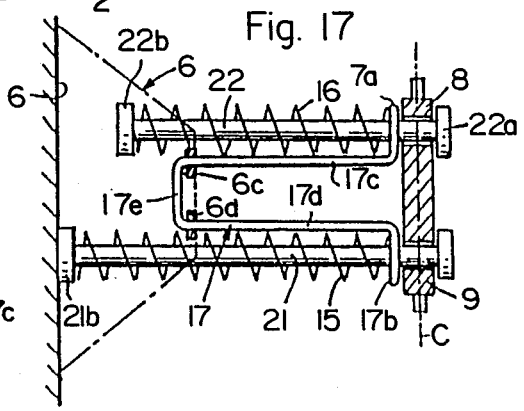
Figure 18:
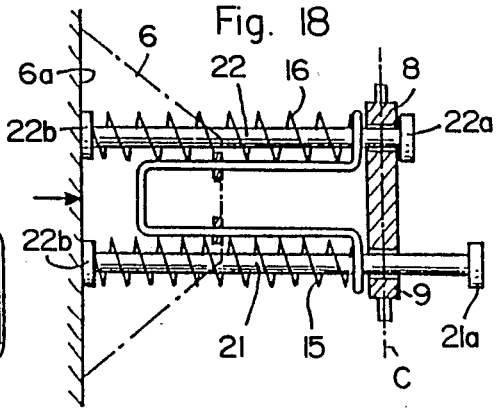

In the embodiment of the invention shown in FIGS. 17 and 18, pedal 6 is connected to two longitudinal shafts 21 and 22 of different lengths on which springs 15 and 16, respectively, are wound or positioned. Shafts 21 and 22, respectively, are provided with enlarged heads 21*a* and 22*a* at their posterior ends and enlarged heads 21*b* and 22*b* at their anterior ends. The posterior heads 21*a* and 22*a* are positioned behind the pivoting bearings 8 and 9 or bar 89 while the anterior heads 21*b* and 22*b* are positioned at the rear end facing the lower interior support surface 6*a* of pedal 6. In the activated braking position, only head 21*b* of longer shaft 21 is in contact with the interior support surface 6*a* of pedal 6. As shown, the head 22*b* of the shorter shaft 22 is situated at a distance from this surface 6*a*. Springs 15 and 16, respectively, which are wound on shafts 21 and 22, are supported at their anterior ends on the looped end sections 17*a* and 17*b* of a tie rod 17 which, in a manner substantially the same as in previously described embodiment, is formed to have a substantially U-shape which is open towards the rear and which is mounted in a similar manner as in the embodiment illustrated in FIGS. 7–14.

In FIG. 17, shafts 21 and 22 of the ski brake are shown in the activated braking position. When the ski brake is placed in the inactive position, by flattening of pedal 6 on the ski, tie rod 17 is displaced frontwardly on the longitudinal shafts 21 and 22 which causes a simultaneous compression of the two springs 15 and 16 which thus cooperate during this movement between the two positions, namely the activated braking position and the inactive position, and vice versa. On the other hand, when the ski brake is moved beyond the activated braking position, i.e., when the arms 4 of the ski brake are subjected to a force F2, in a manner illustrated in FIG. 10, which tends to cause the arms to pivot beyond the activated braking position, pedal 6 which is pushed towards the rear, but only causes longer shaft 21 to move at the beginning of its extent of movement (FIG. 18) because only head 21*b* presses against the lower surface 6*a* of pedal 6 in the activated braking position. Consequently, during this extent of movement only spring 15 intervenes to absorb the shocks.

Furthermore, although the invention has been described with reference to particular means, materials, and embodiments, it is to be understood that the invention is not limited to the particulars disclosed and extends to all equivalents within the scope of the claims.

What is claimed is:

1. A ski brake for use with a ski, said ski brake comprising:

(a) a spade including an arm pivotably mounted around a first pivot axis adapted to be fixed relative to said ski, said arm having a posterior end section equipped with an element adapted to engage snow, and an opposite anterior end section;

(b) a brake pedal pivotably connected anteriorly around a second pivot axis to said anterior end section of said arm, said brake pedal being pivotably mounted around a third pivot axis adapted to be fixed relative to said ski posteriorly of said pivot axis; and (c) means for elastically biasing said spade in a manner so as to move said spade from an inactive position to an activated braking position wherein said element is projected and maintained under said ski, said elastic means comprising means for absorbing shock when said spade is forced into a position beyond said activated braking position and means for returning said spade towards said activated braking position, wherein said second pivot axis is movable relative to said third pivot axis such that in said activated braking position of said spade, said second pivot axis is spaced from said third pivot axis by a lesser amount than in said inactive position of said spade.

2. The ski brake in accordance with claim 1, wherein said spade inclines from top to bottom and front to rear in said activated braking position, wherein said first pivot axis, said second pivot axis, and said third pivot axis form a movable triangle in which said second pivot axis is adapted to be movable relative to said ski and is adapted to be positioned farther from said ski at least in said activated braking position.

3. The ski brake according to claim 2, wherein said movable triangle has at least one side having a variable length.

4. The ski brake according to claim 3, wherein said movable triangle has a side between said second pivot axis and said third pivot axis having a variable length.

5. The ski brake in accordance with claim 2, wherein said pedal is slidably mounted longitudinally on at least one shaft, said shaft being slidable longitudinally in a rear bearing pivotally mounted on said ski around said third pivot axis so that a displacement of said spade beyond said activated braking position causes a rearward sliding movement of said pedal and elastic means for opposing said movement of said pedal beyond a position said pedal occupies when said ski brake is in said activated braking position.

6. The ski brake according to claim 5, wherein said at least one shaft has an enlarged head adapted to press against springs surrounding said shaft and a support surface of said pedal during rearward movement of said pedal.

7. The ski brake according to claim 6, wherein said pedal is connected to two longitudinal shafts of different lengths surrounded by springs, each of said shafts having an elongate section terminating in enlarged end portions and including a posterior enlarged portion positioned behind a pivoting bearing and an anterior enlarge portion adjacent a lower support surface of said pedal such that in an activated braking position only said anterior enlarged portion of said longer shaft is in contact with said lower support surface of said pedal, said shorter shaft being situated at a distance from said lower support surface, each of said springs being wound on a shaft and supported at an anterior end on said looped end portion, said transverse section being situated in front of said abutment of said pedal.

8. The ski brake according to claim 5, wherein said at least one shaft includes two shafts having the same length and said pedal is slidably mounted on said two shafts by means of a linkage and return element comprising a generally U-shaped stirrup slidably mounted in said rear bearing and connected by a transverse bar located at the rear of said rear bearing and constituting and edge limiting forward movement of said stirrup.

9. The ski brake according to claim 8, wherein said pedal has a bottom surface provided with supports having openings, said two shafts passing through said openings, a pair of springs consisting of an anterior spring wound on a front section of said shaft between said head and said support and a posterior spring wound on a rear section of said shaft between said support and said rear bearing.

10. The ski brake according to claim 9 wherein said posterior spring has a tension substantially equal to or less than the tension of said anterior spring.

11. The ski brake according to claim 8 wherein said pedal has a bottom surface provided with a protuberance as an abutment and said linkage and return element further comprises a generally U-shaped tie rod having a transverse section adapted to contact said abutment and two longitudinal arms terminating in looped ends surrounding each of said arms of said stirrup, and a single spring wound around each of said arms of said stirrup having an anterior end supported on a corresponding anterior head of said longitudinal arm and a posterior end supported against said looped end portion of said longitudinal arm.

12. The ski brake according to claim 11 wherein said transverse section of said tie rod is situated in front of said protuberance having an edge limiting the rearward sliding of said tie rod with respect to said pedal.

13. The ski brake according to claim 8 wherein said pedal is connected to said stirrup by means of at least two shafts including a longer shaft having a looped end portion around one arm of said stirrup and an elongate section which extends through one of said openings in said support affixed to said lower surface of said pedal and an enlarged head at an opposited end portion, and a shorter shaft having a looped end portion around another arm of said stirrup, an elongated section extending through another of said openings in said support, and an enlarged head at another end portion, a spring wound on each said arm of said stirrup between said looped end portion and on said head of said arm of said stirrup.

14. A ski brake for use with a ski, said ski brake comprising:

(a) a spade including an arm pivotably mounted around a first pivot axis adapted to be fixed relative to said ski, said arm having a posterior end section equipped with an element adapted to engage snow, and an opposite anterior end section;

(b) a brake pedal pivotably connected anteriorly around a second pivot axis to said anterior end section of said arm, said brake pedal being pivotably mounted around a third pivot axis adapted to be fixed relative to said ski posteriorly of said first pivot axis; and (c) means for elastically biasing said spade in a manner so as to move said spade from an inactive position to an activated braking position wherein said element is projected and maintained under said ski, said elastic means comprising means for absorbing shock when said spade is forced into a position beyond said activated braking position and means for returning said spade towards said activated braking position, wherein said first pivot axis, said second pivot axis, and said third pivot axis form a movable triangle in which at least one side has a variable length as said spade moves between said inactive position and said activated braking position.

15. The ski brake in accordance with claim 14, wherein said at least one variable length side of said movable triangle is defined by said second and third pivot axes, wherein said second pivot axis moves toward said third pivot axis to shorten said variable length side of said movable triangle as said spade moves from said inactive position to said activated braking position.

16. A ski brake assembly comprising;

means for braking a ski adapted to be pivoted from a readiment position to an activated position for arresting a forward sliding ski and a rearward sliding ski, said means for braking comprising a posterior end portion adapted to be journalled relative to said ski and an anterior portion adapted to be journalled relative to said ski;

mean for activating said means for braking, said means for activating being pivotably connected to said means for braking so as to permit said means for braking to be positioned in said activated position, said means for activating comprising (i) means for biasing said means for braking into said activated position, including at least one elongate element operatively associated with at least one elastic element, (ii) a pedal for engagement by a ski boot, said pedal being pivotably connected to said means for braking, said pedal including means for contacting and supporting said means for biasing which extends beneath said pedal, and (iii) means for receiving said means for biasing adapted to be pivotably mounted relative to said ski, including an opening, wherein said at least one elongated element is mounted for slidable movement within said opening and at least one end portion of which is adapted to contact said pedal;

wherein said posterior end portion of said means for braking has a frame end and an elongate section, said elongate section adapted to incline rearwardly and downwardly relative to said ski towards said free end in said activated position for braking a forwardly sliding ski and said elongate section adapted to incline forwardly and downwardly relative to said ski towards said free end in said activated position for braking a rearwardly sliding ski.

17. A ski brake assembly in accordance with claim 16, wherein said means for braking further comprises a transverse journal rotatably mounted relative to said ski and interconnecting said anterior end portion and said posterior end portion.

18. A ski brake assembly in accordance with claim 16, further comprising a support adapted to be attached to the ski and about which said means for receiving is pivotably mounted.

19. A ski brake assembly in accordance with claim 18, further comprising a base adapted to be attached to the ski and about which said posterior end portion of said means for braking is pivotably mounted.

20. The ski brake assembly in accordance with claim 16, wherein said means for biasing includes at least one means for maintaining said at least one spring coil on said elongate element 21. The ski brake assembly in accordance with claim 20, wherein said means for maintaining includes an enlarged portion attached to said opposite end portion of said at least one elongate element, said enlarged portion having a dimension larger than the inner diameter of said spring coil.

22. The ski brake assembly in accordance with claim 21, wherein said means for maintaining includes a tie rod having an elongate section with one end portion adapted to contact said means for supporting.

23. The ski brake assembly in accordance with claim 22, wherein said tie rod has an opposite end portion provided with an annular section looped around said elongate element contacting an end of said at least one spring coil.

24. The ski brake assembly in accordance with claim 23, wherein said means for supporting has an orifice and said elongate element passes through said orifice.

25. The ski brake assembly in accordance with claim 24, wherein said elongate element has a free end provided with a cap having a dimension larger than any dimension of said orifice.

26. The ski brake assembly in accordance with claim 21, wherein said means for biasing comprises two spring coils surrounding said at least one elongate element.

27. The ski brake assembly in accordance with claim 26, wherein said means for supporting is positioned between said two spring coils and said at least one elongate element passes through said orifice.

28. The ski brake assembly in accordance with claim 27, wherein each of said spring coils have substantially the same tension.

29. The ski brake assembly in accordance with claim 27, wherein said two spring coils includes a forward spring coil having a tension different from a rear spring coil.

30. The ski brake assembly in accordance with claim 29, wherein said tension of said forward spring coil is greater than the tension of said rear spring coil.

31. The ski brake assembly in accordance with claim 21, wherein said means for biasing comprises two elongate elements.

32. The ski brake assembly in accordance with claim 31, wherein each of said two elongate elements includes an end provided with said enlarged portion.

33. The ski brake assembly in accordance with claim 32, wherein said two elongate elements have opposite ends interconnected by a transverse section.

34. The ski brake assembly in accordance with claim 33, wherein said transverse section is positioned rearwardly of said means for receiving.

35. The ski brake assembly in accordance with claim 31, wherein one of said two elongate members is longer than another of said two elongate members.

36. The ski brake assembly in accordance with claim 31, wherein said means for biasing comprises at least one tie rod having an elongate section associated with at least one of said two elongate members.

37. The ski brake assembly in accordance with claim 36, wherein said elongate section of one said tie rod is longer than said elongate section of another said tie rod.

* * * * *

UNITED STATES PATENT AND TRADEMARK OFFICE

CERTIFICATE OF CORRECTION

PATENT NO. : 4,856,806

DATED : August 15, 1989

INVENTOR(S) : Joel Arduin

It is certified that error appears in the above-identified patent and that said Letters Patent is hereby corrected as shown below:

Column 7, line 18, change "fl" to ---fl---.
Column 7, line 38, change "Fl" to ---Fl---.

Column 7, line 46, change "Fl" to ---Fl---.
Column 8, line 67, change "shift" to ---shaft---.
Column 9, line 66, change "Fl" to ---Fl---.
Column 10, line 1, change "Fl" to ---Fl---.
Column 10, line 25, change "Fl" to ---Fl---.
Column 13, line 62, change "and" to ---an--- before "edge".
Column 15, line 11, change "mean" to ---means---.
Column 15, line 55, insert ---.--- after "element".

Signed and Sealed this

Ninth Day of June, 1992

*Attest:*

DOUGLAS B. COMER

*Attesting Officer*

*Acting Commissioner of Patents and Trademarks*